US007549469B2

(12) United States Patent
Garcia

(10) Patent No.: US 7,549,469 B2
(45) Date of Patent: Jun. 23, 2009

(54) ADJUSTABLE SWAGE

(75) Inventor: David A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 247 days.

(21) Appl. No.: 11/447,645

(22) Filed: Jun. 6, 2006

(65) Prior Publication Data

US 2007/0277971 A1 Dec. 6, 2007

(51) Int. Cl.
*E21B 23/02* (2006.01)

(52) U.S. Cl. ..... 166/206; 166/212

(58) Field of Classification Search ..... 166/206, 166/212, 217

See application file for complete search history.

(56) References Cited

U.S. PATENT DOCUMENTS 4,842,082 A 6/1989 Springer
2003/0155118 A1 8/2003 Sonnier et al.
2004/0168796 A1 9/2004 Baugh et al.
2005/0161213 A1 7/2005 Sonnier et al.

FOREIGN PATENT DOCUMENTS

EP 1640560 A1 3/2006
WO 02059456 A1 8/2002
WO 2007017355 A1 2/2007

*Primary Examiner*—William P Neuder
(74) *Attorney, Agent, or Firm*—Steve Rosenblatt

(57) ABSTRACT

An adjustable swage features an ability to enhance a radial collapse force when an obstruction in a tubular is encountered to allow radial contraction so that the obstruction can be cleared. The movable segments are configured to elastically bend on high loading so as to create additional radial component force to aid the adjustable swage in reducing its size to clear the obstruction.

19 Claims, 9 Drawing Sheets

ADJUSTABLE SWAGE

FIELD OF THE INVENTION

The field of the invention is swages that adjust in diameter for expanding tubulars and more particularly that have the ability to collapse if an obstruction is encountered to clear past it.

BACKGROUND OF THE INVENTION

Swages are used to expand downhole diameter of tubulars. They can be fixed conical shapes or they can be adjusted to change diameter downhole. The swages that can change diameter can be more versatile in that they can do expansion of a given tubular in stages to avoid overstressing. They can be collapsed after the expansion is complete to facilitate removal.

There are concerns when using adjustable swages that involve a plurality of segments that do the expansion. Gaps between the segments can cause lines of stress concentration that can ultimately create a fracture longitudinally. An adjustable swage design is disclosed in U.S. Publication Number 2003/01558118 A1 that involves wedge shaped segments that translate with respect to each other. Alternating wedges are held fixed while the movable segments are powered by a hydraulic piston. Applied pressure moves the movable segments into alignment with the stationary segments so that their high spots align to create the swaging diameter. The segments are dovetailed on an incline so that as they move relatively into alignment they also move radially into a larger radius. A ratchet system is incorporated to hold the position of the segments attained in response to applied hydraulic pressure to the piston. The discussion below of the basic components of this adjustable swage gives the general starting point for the present invention.

Additional flexibility can be achieved by using flexible swage 138. FIG. 1 shows it in perspective and FIGS. 2*a*-2*c* show how it is installed above a fixed swage 134. The adjustable swage 138 comprises a series of alternating upper segments 140 and lower segments 142. The segments 140 and 142 are mounted for relative, preferably slidable, movement. Each segment, 140 for example, is dovetailed into an adjacent segment 142 on both sides. The dovetailing can have a variety of shapes in cross-section; however an L shape is preferred with one side having a protruding L shape and the opposite side of that segment having a recessed L shape so that all the segments 140 and 142 can form the requisite swage structure for 360 degrees around mandrel 144. The opening 148 made by the segments 140 and 142 (see FIG. 1) fits around mandrel 144.

Segments 140 have a wide top 150 tapering down to a narrow bottom 152 with a high area 154, in between. Similarly, the oppositely oriented segments 142 have a wide bottom 156 tapering up to a narrow top 158 with a high area 160, in between. The high areas 154 and 160 are preferably identical so that they can be placed in alignment, as shown in FIG. 3*a*. The high areas 154 and 160 can also be lines instead of bands. If band areas are used they can be aligned or askew from the longitudinal axis. The band area surfaces can be flat, rounded, elliptical or other shapes when viewed in section. The preferred embodiment uses band areas aligned with the longitudinal axis and slightly curved. The surfaces leading to and away from the high area, such as 162 and 164 for example can be in a single or multiple inclined planes with respect to the longitudinal axis.

Segments 140 have a preferably T shaped member 166 engaged to ring 168. Ring 168 is connected to mandrel 144 at thread 170. During run in a shear pin 172 holds ring 168 to mandrel 144. Lower segments 142 are retained by T shaped members 174 to ring 176. Ring 176 is biased upwardly by piston 178. The biasing can be done in a variety of ways with a stack of Belleville washers 180 illustrated as one example. Piston 178 has seals 182 and 184 to allow pressure through opening 186 in the mandrel 144 to move up the piston 178 and pre-compress the washers 180. A lock ring 188 has teeth 190 to engage teeth 192 on the fixed swage 134, when the piston 178 is driven up. Thread 194 connects fixed swage 134 to mandrel 144. Opening 186 leads to cavity 196 for driving up piston 178. Preferably, high areas 154 and 160 do not extend out as far as the high area 198 of fixed swage 134 during the run in position shown in FIG. 2. The fixed swage 134 can have the variation in outer surface configuration previously described for the segments 140 and 142.

The operation of the method using the flexible swage 138 will now be described. The swage 134 makes contact with an obstruction. At first, an attempt to set down weight could be tried to see if swage 134 could go through the damaged portion of the casing. If this fails to work, pressure is applied from the surface. If the fixed swage 134 goes through the obstruction, the flexible swage could then land on the obstruction and then be expanded and driven through it. Pressure from the surface enters opening 186 and forces piston 178 to compress washers 180, as shown in FIG. 3*b*. Lower segments 142 rise in tandem with piston 178 and ring 176 until no further uphole movement is possible. This can be defined by the contact of the segments 140 and 142 with the casing or tubular 133. This contact may occur at full extension illustrated in FIG. 3*b* or 4, or it may occur short of attaining that position. The full extension position is defined by alignment of high areas 154 and 160. Washers 180 apply a bias to the lower segments 142 in an upward direction and that bias is locked in by lock ring 188 as teeth 190 and 192 engage as a result of movement of piston 178. At this point, downward stroking from the force magnification tool 66 forces the swage downwardly. The friction force acting on lower segments 142 augments the bias of washers 180 as the flexible swage 138 is driven down. This tends to keep the flexible swage at its maximum diameter for 360 degree swaging of the casing or tubular 133. The upper segments do not affect the load on the washers 180 when moving the flexible swage 138 up or down in the well, in the position shown in FIG. 3*a*.

What the above description from the original disclosure didn't go into much detail about is what happens when segments 140 and 142 are in alignment and encounter an obstruction through which the fixed cone 134 has already cleared. Two things can happen. If the adjustable swage is to clear the obstruction, it needs to get smaller in diameter by moving from the FIG. 3*a* position back to the FIG. 2*a* position. Since segments 142 are required to move down to do this, there clearly needs to be a radial reaction force to urge the separation of the segments 140 and 142 to go to a smaller diameter through a resulting longitudinal relative movement. However the radial force must be large enough to create a longitudinal component greater than the reaction force resulting from pushing the adjustable swage against the obstruction. In other words, as shown in FIG. 3*a*, the aligned segments 140 and 142 are up against the tubular 10. Arrow 12 represents the pushing force from the surface that is generally coming from a set anchor and a hydraulic stroker (not shown). Other ways to create the pushing force can be used. Since the angle of surface 14 is very steep the radial component of any reaction force 16 is also very small, compared to the vertical reaction force 18 which is equal to the pushing from the surface 12, as illustrated in FIG. 3*a*. It is the radial force 16 that is necessary to get the diameter of the adjustable swage smaller so that it can pass the obstruction in the tubular 10. This radial component force is what drives the wedges 140 and 142 from the FIG. 4 position to the FIG. 1 position along their sloping tongue and groove edge connections. In essence the segments 142 push the fixed swage 134 downhole for the adjustable swage to reduce in diameter by assuming the FIG. 2*a* position. If the radial component is not sufficient to overcome the resistance to relative movement of the segments 140 and 142 under the loading imposed from being stuck against the tubular 10 the assembly will simply stall and not get through the obstruction.

What the present invention attempts to do is to enhance the radial force that urges collapse of the adjustable swage when it gets stuck on an obstruction that the fixed swage 134 has already passed. The invention seeks to redirect the longitudinal loading force to create an additional radial component when the adjustable swage is stuck. One way this is accomplished is to alter the loading angles on the mounts for the segments so as to create additional radial load component when the adjustable swage sticks in the tubular on an obstruction. Those skilled in the art will better appreciate the full scope of the invention from the claims below. The detailed description and drawings illustrate the concept of the invention by showing the preferred embodiment.

SUMMARY OF THE INVENTION

An adjustable swage features an ability to enhance a radial collapse force when an obstruction in a tubular is encountered to allow radial contraction so that the obstruction can be cleared. The movable segments are configured to elastically bend on high loading so as to create additional radial component force to aid the adjustable swage in reducing its size to clear the obstruction.

DETAILED DESCRIPTION OF THE DRAWINGS

FIG. 1 is a perspective view of a prior art adjustable swage in its smaller dimension;

FIGS. 2*a*-2*c* are a prior art section view of the adjustable swage in the FIG. 1 position;

FIGS. 3*a*-3*c* are the view of FIGS. 2*a*-2*c* but in the maximum dimension for the adjustable swage;

DETAILED DESCRIPTION OF THE PREFERRED EMBODIMENT

Figure 1:
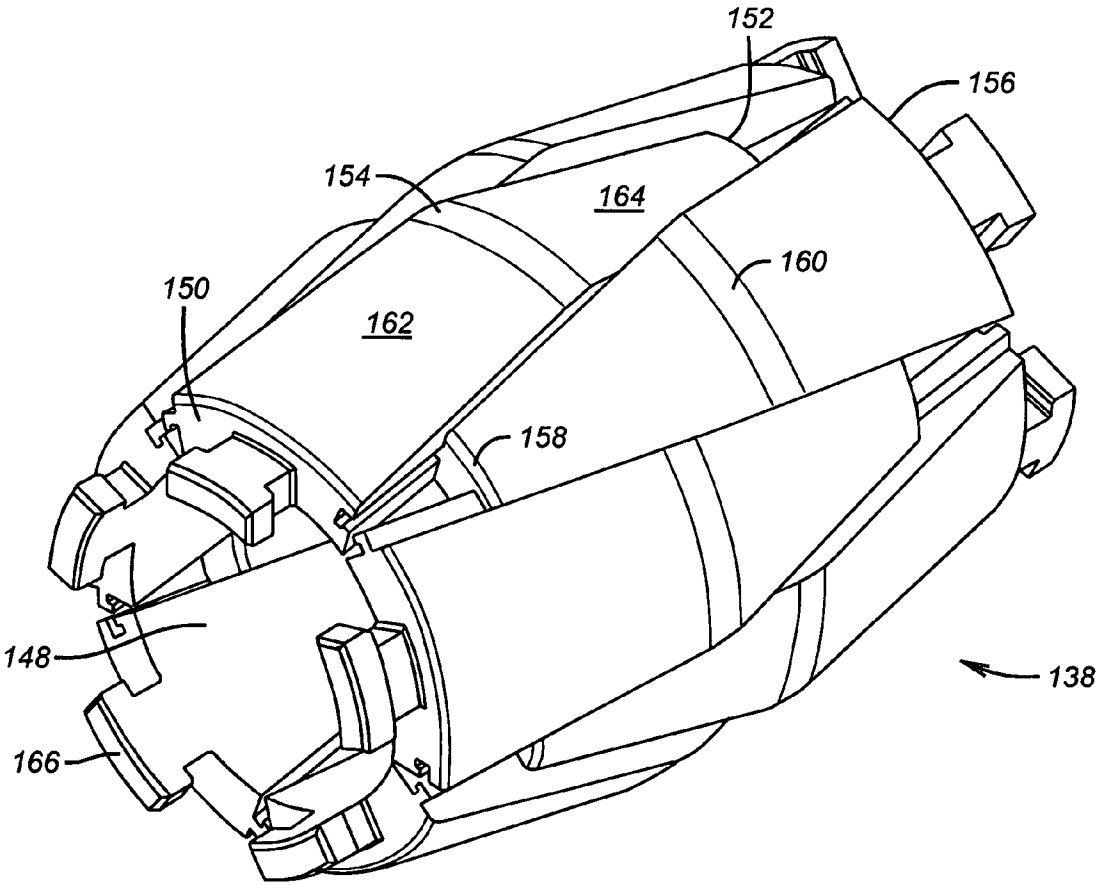
(PRIOR ART) FIG. 1
Figure 2A:
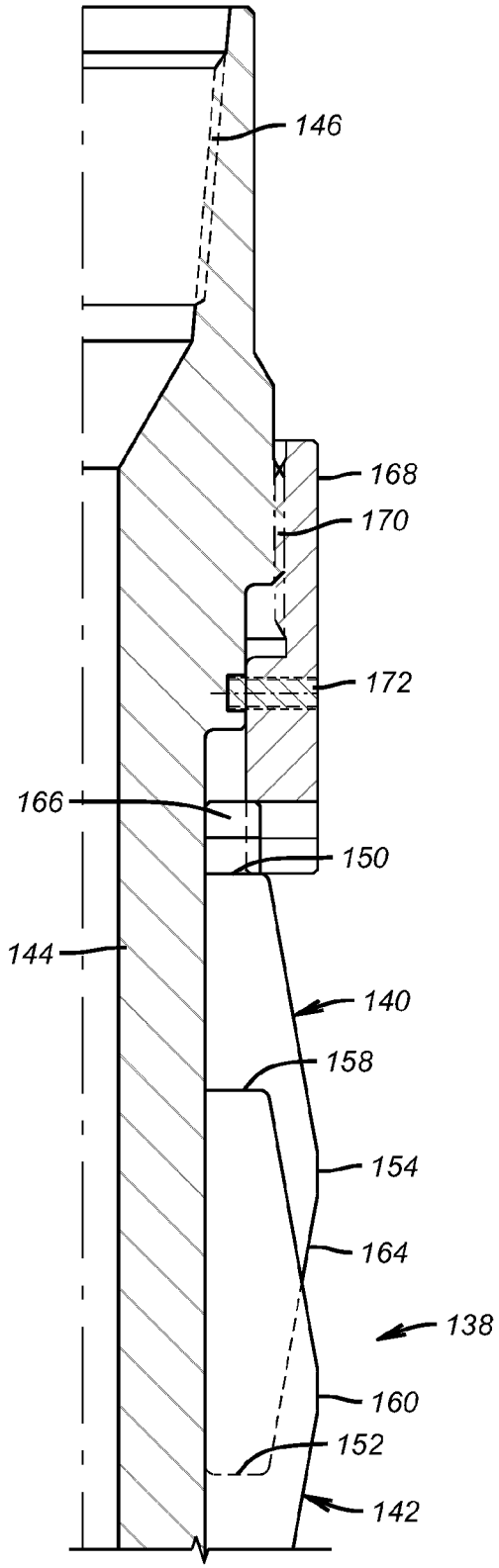
(PRIOR ART) FIG. 2a
Figure 3A:
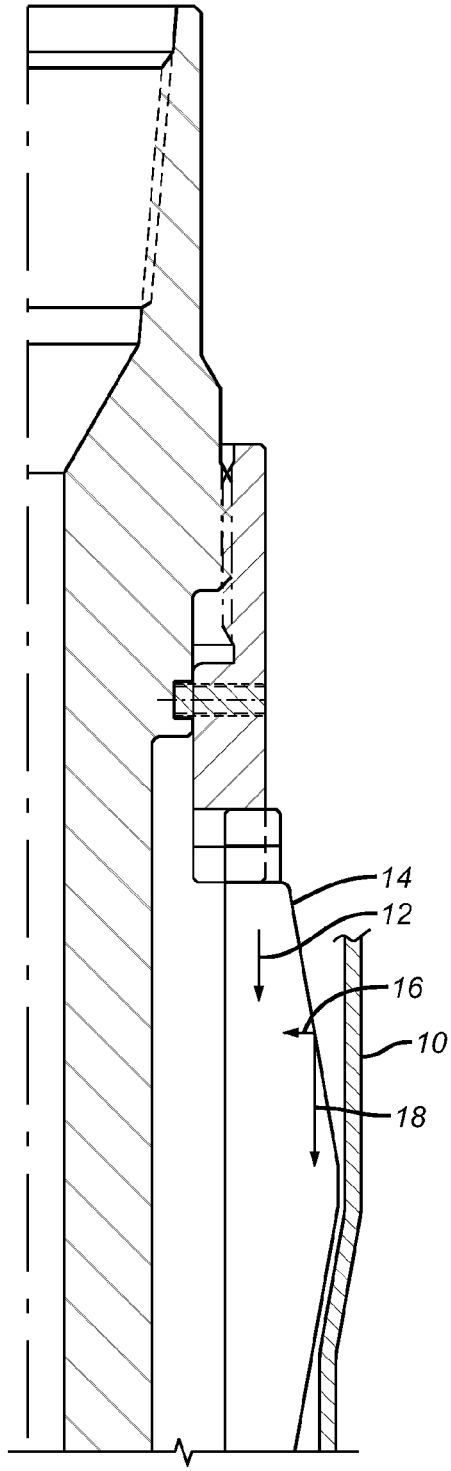
(PRIOR ART) FIG. 3a
Figure 2B:
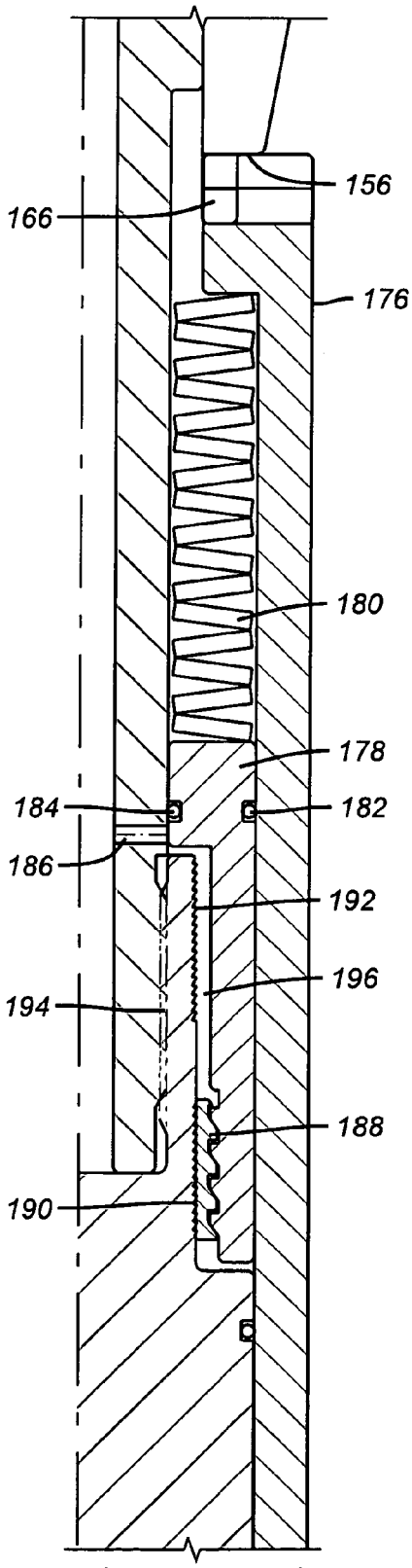
(PRIOR ART) FIG. 2b
Figure 3B:
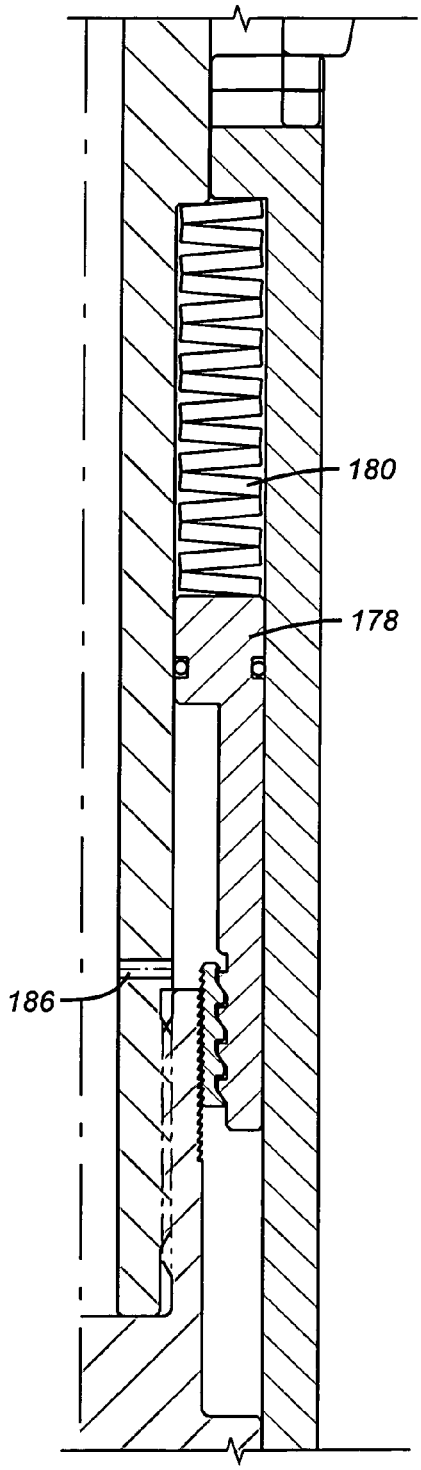
(PRIOR ART) FIG. 3b
Figure 2C:
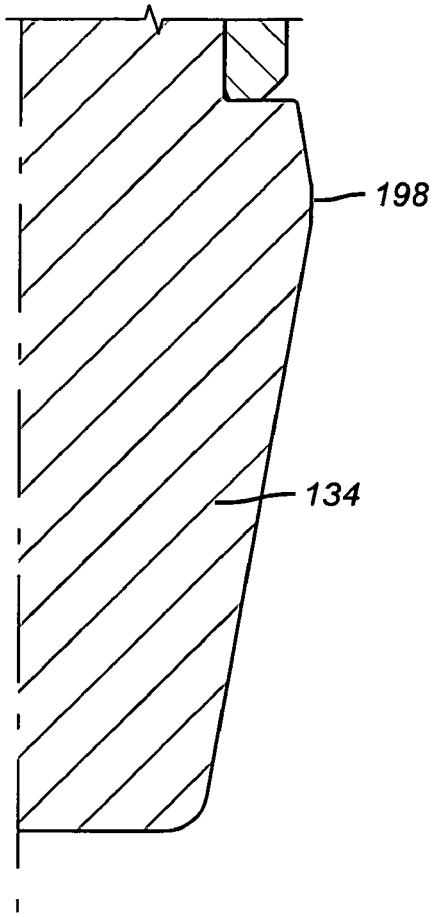
(PRIOR ART) FIG. 2c
Figure 3C:
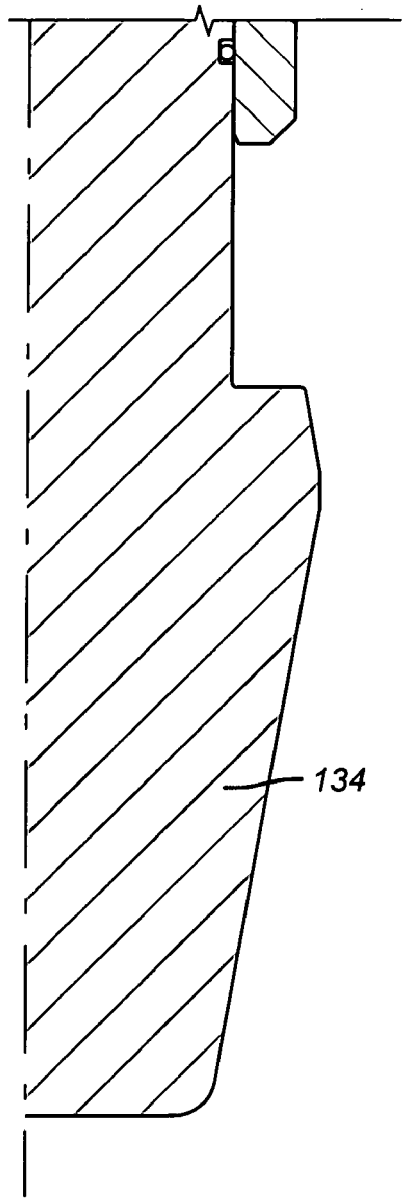
(PRIOR ART) FIG. 3c
Figure 4:
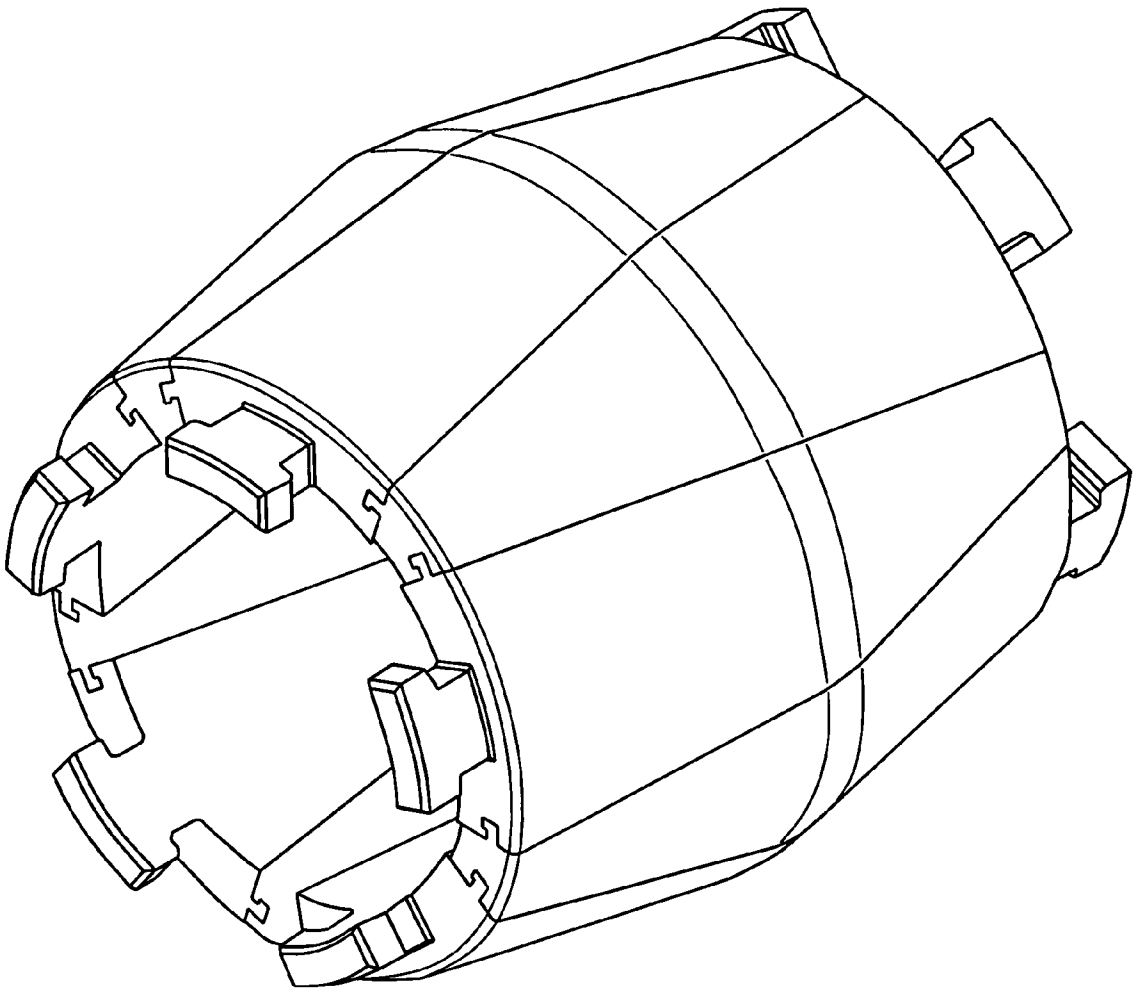
(PRIOR ART) FIG. 4
FIG. 4 shows the prior art adjustable swage in its maximum dimension.
Figure 5:
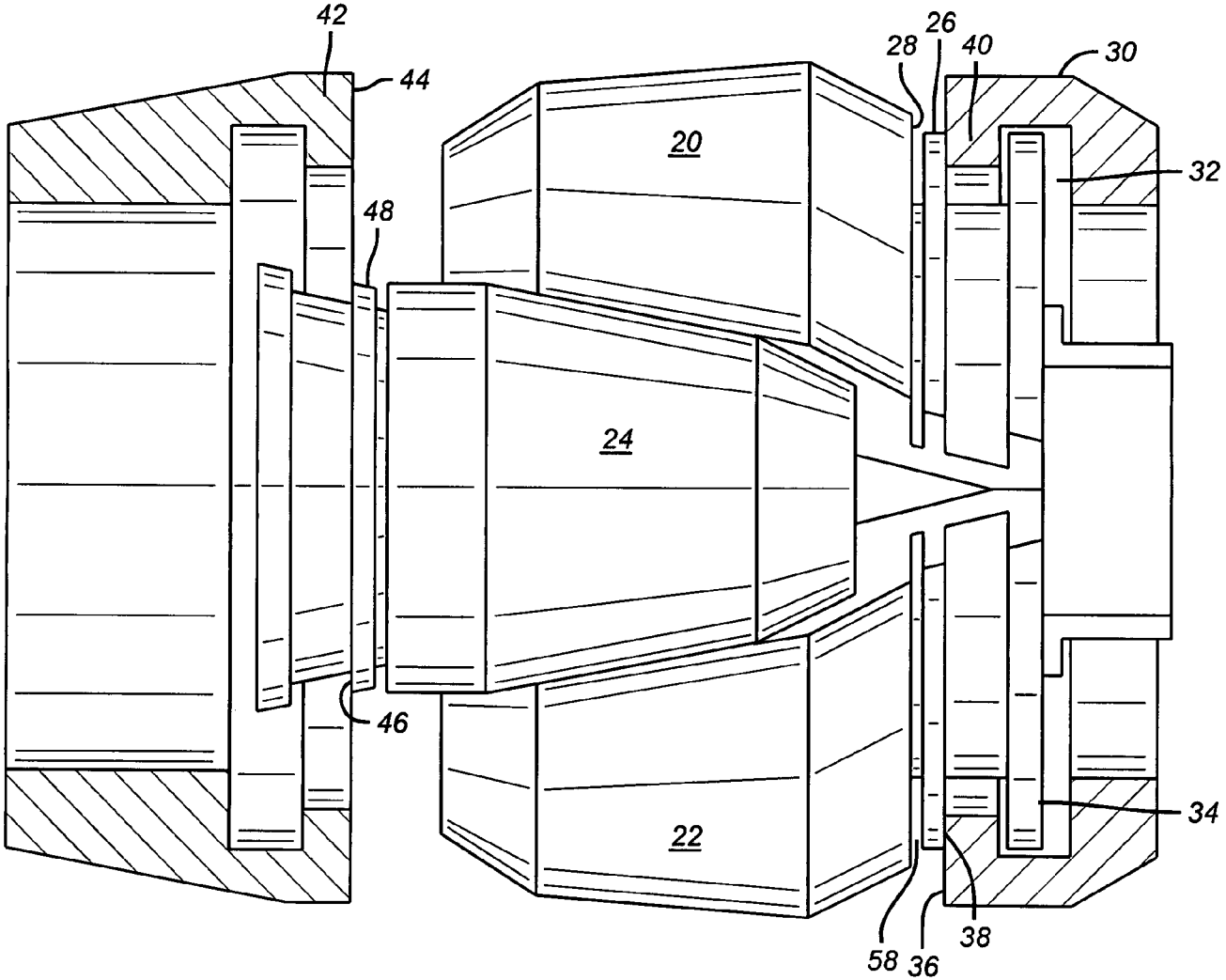
FIG. 5 is a perspective view of the present invention during normal operation.

FIG. 5 shows wedge segments 20 and 22 oriented in the same direction with segment 24 going the other way. The layout of the segments and how they are joined together is identical to the view in FIG. 1 and the basic operation of the adjustable swage discussed above will not be repeated. What is unique about the arrangement will now be reviewed.

Segments 20 and 22 and the other similarly situated segments that are not shown preferably have a flexible flange 26 spaced apart from base surface 28. Retainer 30 has an inner recess 32 that holds a guide flange 34 that is part of the segment 20 or 22 or the other similarly situated segments that are not shown. Retainer 30 has a bearing surface 36 that contacts surface 38 on flexible flange 26. Surface 38 is part of an inwardly oriented ring 40 that defines circular recess 32. The connection arrangement for the oppositely oriented segments is substantially the same with ring 42 having a bearing surface 44 to contact surface 46 on flexible flange 48 on segment 24 and the others that are similarly oriented and not shown.

Figure 7:
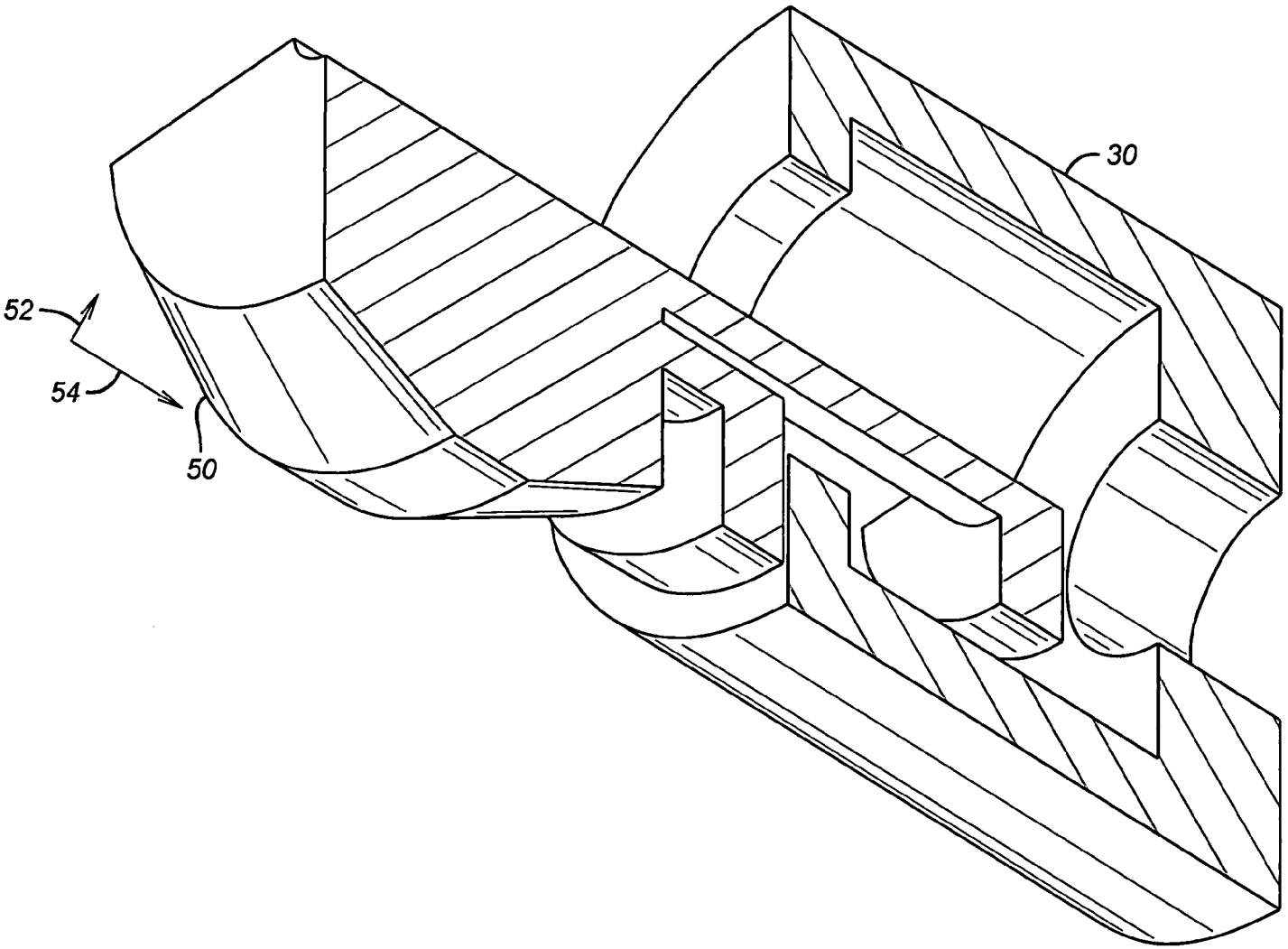
FIG. 7 shows a single segment of the adjustable swage during normal operation.

When the segments that make up the adjustable swage hit an obstruction the contact location is still on steep surface 50 as shown in FIG. 7. When the segments hit the obstruction at surface 50 the applied force increases from retainer 30. This creates a reaction force similar to what was shown in FIG. 7. As before, the radial component 52 is quite small when compared to the longitudinal component 54. As before in FIG. 5, it is the radial component that drives the segments in the adjustable swage to go to a smaller diameter by moving them relatively along their inclined dovetail connection to essentially advance the fixed swage 134 that has already cleared the obstruction. Here again, if the generated radial component was sufficiently small the adjustable swage segments would not move relatively to each other because the generated force would not be strong enough to advance the fixed swage 134 to allow the peaks 154 and 160 the ability to separate. The adjustable swage would simply stall at the obstruction.

Figure 6:
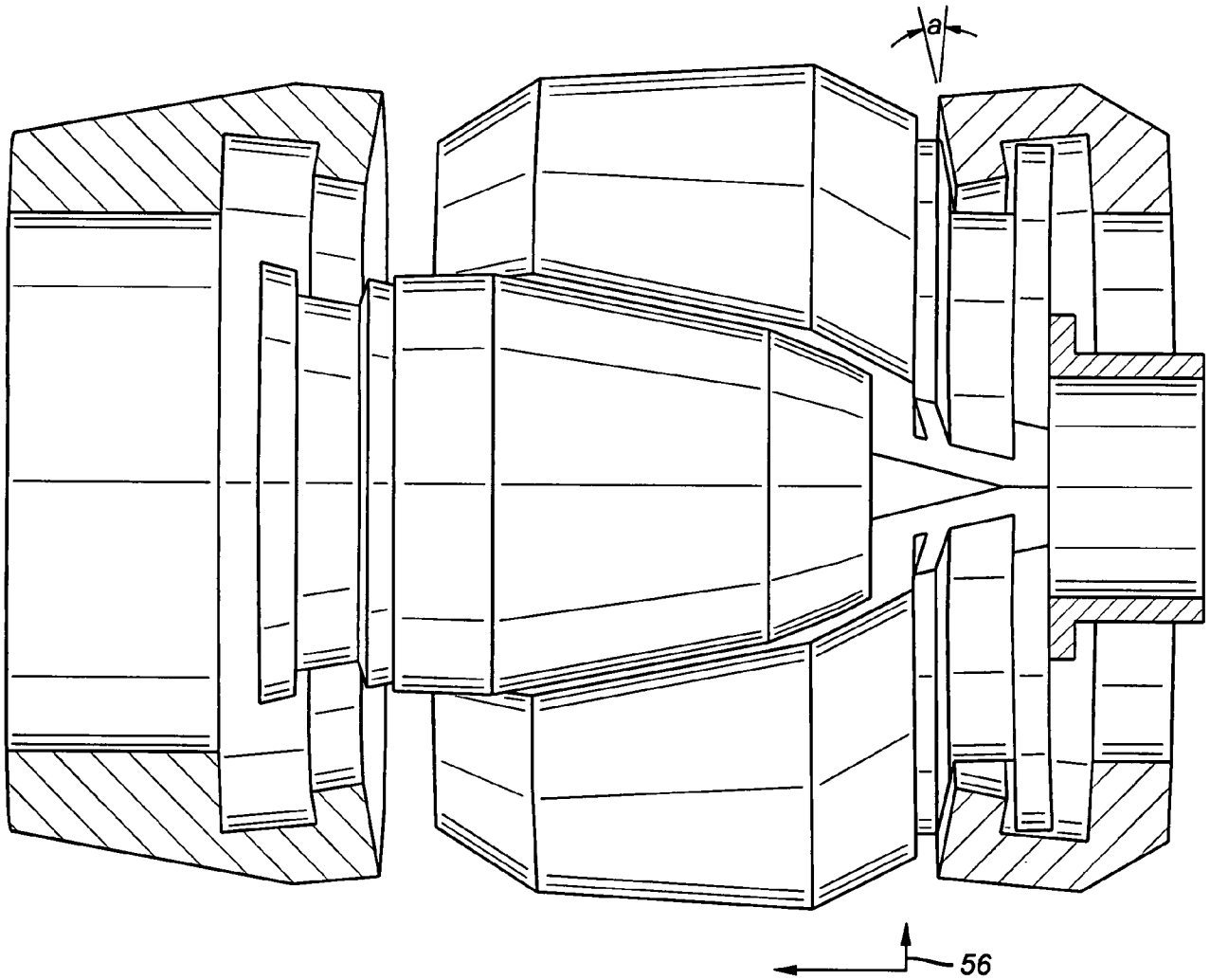
FIG. 6 is the view of FIG. 5 showing what happens when the adjustable swage reaches an obstruction.
Figure 8:
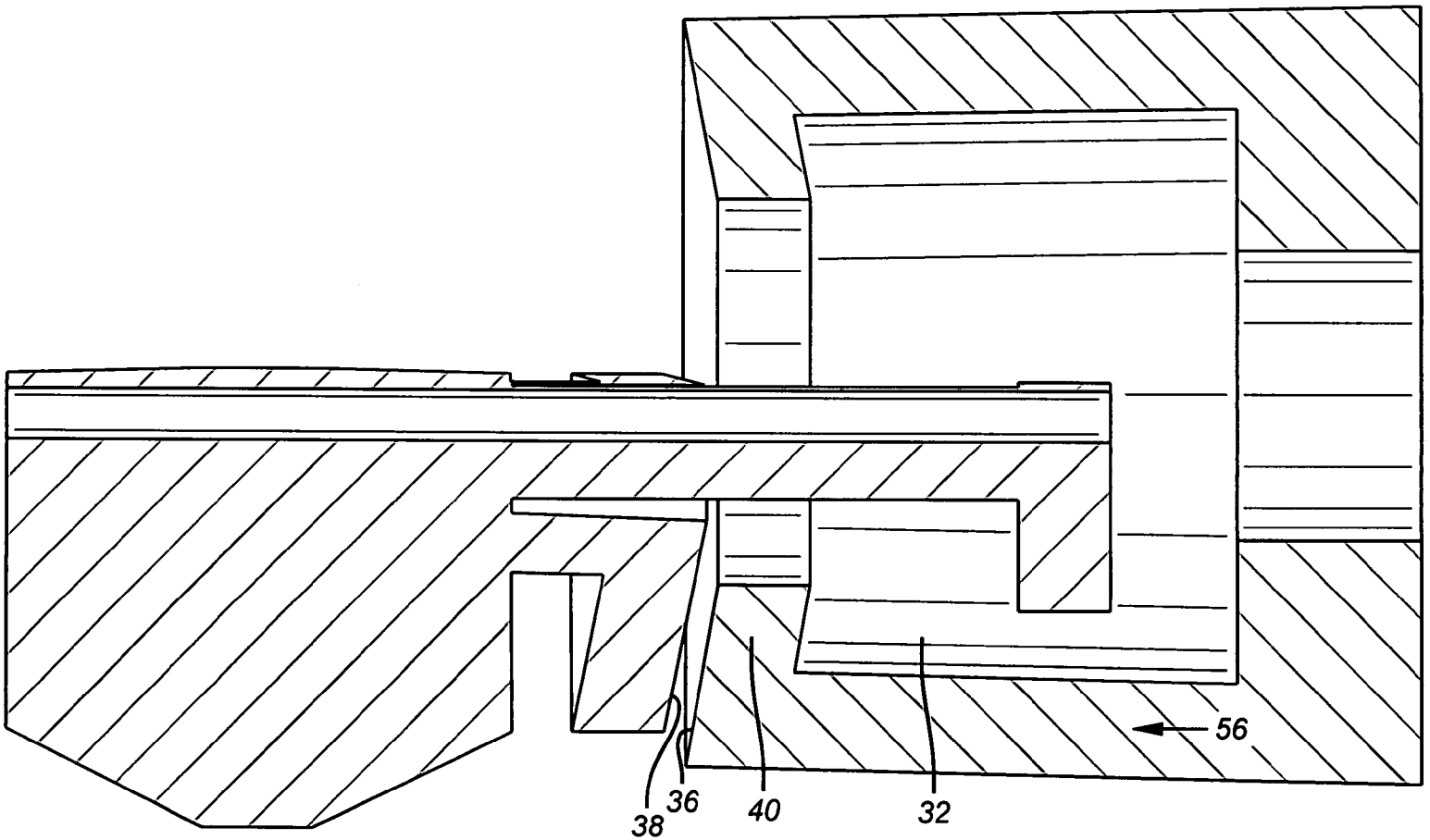
FIG. 8 is the view of FIG. 7 when an obstruction in the tubular to be expanded is encountered.

The present invention addresses this situation as the loading increases when an obstruction is hit. FIG. 8 shows that ring 40 has bent elastically toward recess 32 thus placing the loading surface 36 on an incline where the mating surface 38 has the same angle because of the way the surfaces engage each other and the way they are each supported. Now a loading force delivered through ring 40 and represented by arrow 56 results in skewing the contact axis between surfaces 36 and 38 by angle a in FIG. 6. As a result of such surface skewing a radial component of force is generated as indicated by arrow 56. This radial load is over and above the radial load generated by the direct contact of the segments with the obstruction as illustrated in FIG. 5. As a result the adjustable swage is now more likely to clear an obstruction rather than stall due to the additional radial collapse force provided.

Those skilled in the art will appreciate that both ends can have the same treatment to create a radial component force at both ends even though only one end has been described. While the creation of the additional radial force has been accomplished with bending load surfaces other ways to create a radial force when an obstruction is hit are also within the scope of the invention. In the preferred embodiment the additional radial force is not created until an obstruction is hit so that in normal expansion operation the operation of the adjustable swage described is similar to the prior art operation. In that sense a radial collapsing force is not created during normal operations when it is not needed. Rather, it is when an obstruction is encountered and the adjustable swage needs to get smaller in diameter to get past that obstruction that the bending takes place and the collapse force comes into play to get the adjustable swage past the obstruction.

Additionally, the size of gap 58 adjacent flexible flange 26 is sized such that even when flange 26 closes gap 58, the bending is still in the elastic range.

The above description is illustrative of the preferred embodiment and many modifications may be made by those skilled in the art without departing from the invention whose scope is to be determined from the literal and equivalent scope of the claims below.

I claim:

1. An adjustable swage for downhole use, comprising:

a plurality of connected segments capable of relative movement between a larger and a smaller radial dimension about a longitudinal axis;

at least one support mounted to at least one of said segments, said support configured to flex and due to said flexing to create or enhance a radially directed force on at least one of said segments to urge radial movement toward said smaller radial dimension.

2. The adjustable swage of claim 1, wherein:

said support applies said force to at least one of said segments to urge movement toward said smaller radial dimension only after a predetermined load is applied through it.

3. The adjustable swage of claim 1, wherein:

said support is articulated to change direction of force applied through it.

4. The adjustable swage of claim 1, wherein:

said support further comprises a load surface that bends under a predetermined force.

5. The adjustable swage of claim 4, wherein:

said bending is in the elastic range for said support.

6. The adjustable swage of claim 1, wherein:

at least one of said segments comprises a flexible surface to engage said support.

7. The adjustable swage of claim 6, wherein:

said flexible surface bends under a predetermined load from said support.

8. The adjustable swage of claim 7, wherein:

said flexible surface bends within its elastic range.

9. The adjustable swage of claim 8, wherein:

said flexible surface is limited in the extent of bending by contact with the segment that supports it.

10. The adjustable swage of claim 2, wherein:

said at least one support comprises two supports with each support connected to half the segments and said segments movable longitudinally relative to each other by relative movement between said supports;

both said supports configured to apply a force on all of said segments to urge movement toward said smaller radial dimension when a predetermined load is applied through said supports.

11. The adjustable swage of claim 10, wherein:

said supports each further comprise a load surface that bends under a predetermined force.

12. An adjustable swage for downhole use, comprising:

a plurality of connected segments capable of relative movement between a larger and a smaller radial dimension about a longitudinal axis;

at least one support mounted to at least one of said segments, said support configured to apply a longitudinally oriented force on at least one of said segments;

at least one of said segments further configured to redirect said longitudinally oriented force applied by said support to create or enhance a radial component force to urge segment movement toward said smaller radial dimension by flexing of said support.

13. The adjustable swage of claim 12, wherein:

said redirection of force occurs after a predetermined load through said support is applied to said segment.

14. An adjustable swage for downhole use, comprising:

a plurality of connected segments capable of relative movement between a larger and a smaller radial dimension about a longitudinal axis;

at least one support mounted to at least one of said segments, said support configured to apply a force on at least one of said segments;

at least one of said segments further configured to redirect said force applied by said support to urge segment movement toward said smaller radial dimension;

said redirection of force occurs after a predetermined load through said support is applied to said segment;

said redirection of force occurs as a result of bending of a load surface on said segment.

15. The adjustable swage of claim 14, wherein:

said bending is in the elastic range.

16. The adjustable swage of claim 15, wherein:

said load surface is spaced apart from the bulk of said segment to create a gap that closes when said load surface bends, said gap is sized to prevent plastic deformation of said load surface.

17. The adjustable swage of claim 16, wherein:

said at least one support comprises two supports with each support connected to half the segments and said segments movable longitudinally relative to each other by relative movement between said supports;

all said segments comprising a said load surface.

18. The adjustable swage of claim 17, wherein:

at least one of said supports is configured to redirect a force applied through it to urge said segments toward said smaller radial dimension upon application of said predetermined load.

19. The adjustable swage of claim 18, wherein:

said support further comprises a load surface that bends under a predetermined force.

* * * * *